US006497231B1

(12) United States Patent
White

(10) Patent No.: US 6,497,231 B1
(45) Date of Patent: Dec. 24, 2002

(54) HYPERBARIC OXYGEN CHAMBER

(76) Inventor: Perry La'Monte White, 433 Fourth Ave. Southwest #5, Cedar Rapids, IA (US) 52404

( * ) Notice: Subject to any disclaimer, the term of this patent is extended or adjusted under 35 U.S.C. 154(b) by 0 days.

(21) Appl. No.: 09/534,480

(22) Filed: Mar. 24, 2000

(51) Int. Cl.[7] ..... A61G 10/00

(52) U.S. Cl. ..... 128/202.12; 128/205.26

(58) Field of Search ..... 128/202.12, 202.13, 128/202.15, 205.26, 845, 846, 201.27, 201.28, 202.16, 202.18; 600/21, 22; 405/186, 187; 362/384, 403, 457, 190

(56) References Cited

U.S. PATENT DOCUMENTS

| | | | | | |
|---|---|---|---|---|---|
| 2,104,589 | A | * | 1/1938 | Hartman | 128/191 |
| 2,240,819 | A | * | 5/1941 | Waly | 128/145 |
| 3,255,751 | A | | 6/1966 | Bouet | |
| 3,729,002 | A | * | 4/1973 | Miller | 128/204 |
| 4,253,198 | A | * | 3/1981 | Estabrook | 2/82 |
| 4,441,145 | A | * | 4/1984 | Antkowiak | 362/384 |
| 4,446,508 | A | * | 5/1984 | Kinzie | 362/31 |
| 4,467,798 | A | | 8/1984 | Saxon et al. | |
| 4,509,513 | A | | 4/1985 | Lasley | |
| 4,727,870 | A | | 3/1988 | Krasle | |
| 4,757,430 | A | * | 7/1988 | Dubak et al. | 362/100 |
| 4,974,829 | A | | 12/1990 | Gamow et al. | |
| 5,046,193 | A | * | 9/1991 | Foresman et al. | 2/68 |
| 5,063,924 | A | * | 11/1991 | Galvan et al. | 128/202.12 |
| 5,083,558 | A | * | 1/1992 | Thomas et al. | 128/202.12 |
| 5,446,934 | A | * | 9/1995 | Frazier | 5/655 |
| 5,467,764 | A | | 11/1995 | Gamow | |
| 5,551,616 | A | * | 9/1996 | Stitt et al. | 224/275 |
| 5,749,374 | A | * | 5/1998 | Schneider, Sr. | 128/870 |
| 5,799,652 | A | * | 9/1998 | Kotliar | 128/205.11 |
| 5,815,862 | A | * | 10/1998 | Rygiel | 5/632 |
| 5,964,222 | A | * | 10/1999 | Kotliar | 128/205.26 |
| 5,979,722 | A | * | 11/1999 | Gonzales | 224/153 |
| 6,006,136 | A | * | 12/1999 | Glucksman | 607/98 |
| 6,022,310 | A | * | 2/2000 | Goldberg et al. | 600/22 |
| 6,024,089 | A | * | 2/2000 | Wallace et al. | 128/204.21 |
| 6,206,260 | B1 | * | 3/2001 | Covell et al. | 224/539 |
| 6,219,864 | B1 | * | 4/2001 | Ellis et al. | 5/600 |
| 6,234,172 | B1 | * | 5/2001 | Ausbourne et al. | 128/845 |

FOREIGN PATENT DOCUMENTS

| | | | |
|---|---|---|---|
| EP | 0113149 | * | 7/1984 |
| GB | 2086731 | * | 5/1982 |
| GB | 2220573 A | * | 1/1990 |

* cited by examiner

*Primary Examiner*—Glenn K. Dawson
*Assistant Examiner*—Teena Mitchell

(57) ABSTRACT

A hyperbaric oxygen chamber for allowing the user of the chamber to breathe pure oxygen while sleeping or relaxing. The hyperbaric oxygen chamber includes a chamber structure having a base and a cover, a vent system in the base of the chamber structure for permitting the gas to move in and out of the chamber structure, a valve assembly for use with the vent system, a control panel, a lighting assembly, and a support structure.

18 Claims, 7 Drawing Sheets

HYPERBARIC OXYGEN CHAMBER

BACKGROUND OF THE INVENTION

1. Field of the Invention

The present invention relates to chambers with altered atmospheric conditions and more particularly pertains to a new hyperbaric oxygen chamber for allowing the user of the chamber to breathe pure oxygen while sleeping or relaxing.

2. Description of the Prior Art

The use of chambers with altered atmospheric conditions is known in the prior art. More specifically, chambers with altered atmospheric conditions heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,467,764; 4,974,829; 4,727,870; 4,467,798; 3,255,751; and 4,509,513.

While these devices fulfill their respective, particular objectives and requirements, the aforementioned patents do not disclose a new hyperbaric oxygen chamber. The inventive device includes a chamber structure including a base and a cover, a vent system in the base of the chamber structure for permitting the gas to move in and out of the chamber structure, a valve assembly for use with the vent system, a control panel, a lighting assembly, and a support structure.

In these respects, the hyperbaric oxygen chamber according to the present invention substantially departs from the conventional concepts and designs of the prior art, and in so doing provides an apparatus primarily developed for the purpose of allowing the user of the chamber to breathe pure oxygen while sleeping or relaxing.

SUMMARY OF THE INVENTION

In view of the foregoing disadvantages inherent in the known types of chambers with altered atmospheric conditions now present in the prior art, the present invention provides a new hyperbaric oxygen chamber construction wherein the same can be utilized for allowing the user of the chamber to breathe pure oxygen while sleeping or relaxing.

The general purpose of the present invention, which will be described subsequently in greater detail, is to provide a new hyperbaric oxygen chamber apparatus and method which has many of the advantages of the chambers with altered atmospheric conditions mentioned heretofore and many novel features that result in a new hyperbaric oxygen chamber which is not anticipated, rendered obvious, suggested, or even implied by any of the prior art chambers with altered atmospheric conditions, either alone or in any combination thereof.

To attain this, the present invention generally comprises a chamber structure including a base and a cover, a vent system in the base of the chamber structure for permitting the gas to move in and out of the chamber structure, a valve assembly for use with the vent system, a control panel, a lighting assembly, and a support structure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hyperbaric oxygen chamber apparatus and method which has many of the advantages of the chambers with altered atmospheric conditions mentioned heretofore and many novel features that result in a new hyperbaric oxygen chamber which is not anticipated, rendered obvious, suggested, or even implied by any of the prior art chambers with altered atmospheric conditions, either alone or in any combination thereof.

It is another object of the present invention to provide a new hyperbaric oxygen chamber which may be easily and efficiently manufactured and marketed.

It is a further object of the present invention to provide a new hyperbaric oxygen chamber which is of a durable and reliable construction.

An even further object of the present invention is to provide a new hyperbaric oxygen chamber which is susceptible of a low cost of manufacture with regard to both materials and labor, and which accordingly is then susceptible of low prices of sale to the consuming public, thereby making such hyperbaric oxygen chamber economically available to the buying public.

Still yet another object of the present invention is to provide a new hyperbaric oxygen chamber which provides in the apparatuses and methods of the prior art some of the advantages thereof, while simultaneously overcoming some of the disadvantages normally associated therewith.

Still another object of the present invention is to provide a new hyperbaric oxygen chamber for allowing the user of the chamber to breathe pure oxygen while sleeping or relaxing.

Yet another object of the present invention is to provide a new hyperbaric oxygen chamber which includes a chamber structure that includes a base and a cover, a vent system in the base of the chamber structure for permitting the gas to move in and out of the chamber structure, a valve assembly for use with the vent system, a control panel, a lighting assembly, and a support structure.

Still yet another object of the present invention is to provide a new hyperbaric oxygen chamber that allows the user of the chamber to breathe better, feel better, and live longer.

Even still another object of the present invention is to provide a new hyperbaric oxygen chamber that permits the user of the chamber to escape the germs present in the environment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
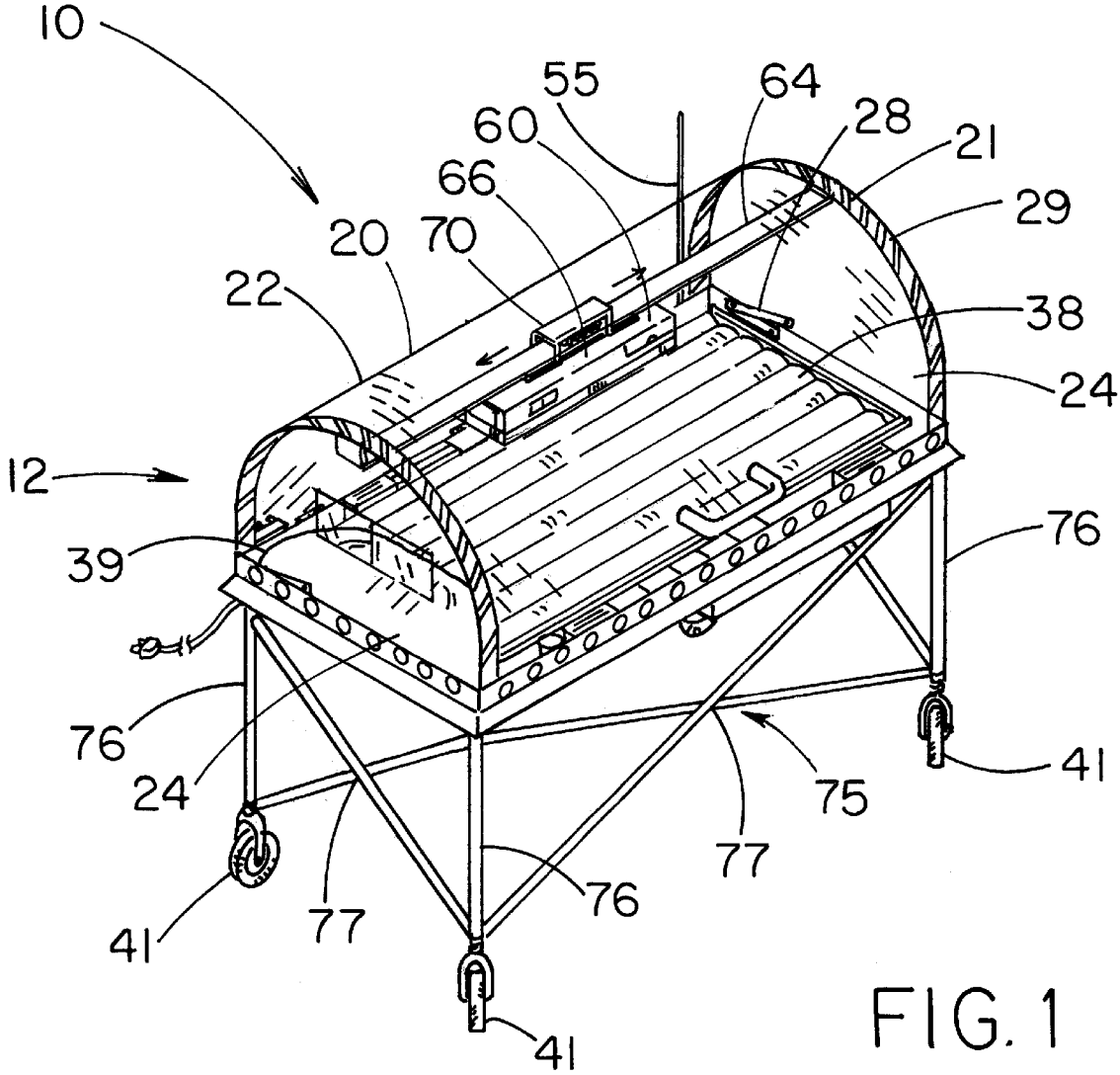
FIG. 1 is a schematic perspective view of a new hyperbaric oxygen chamber according to the present invention.
Figure 2:
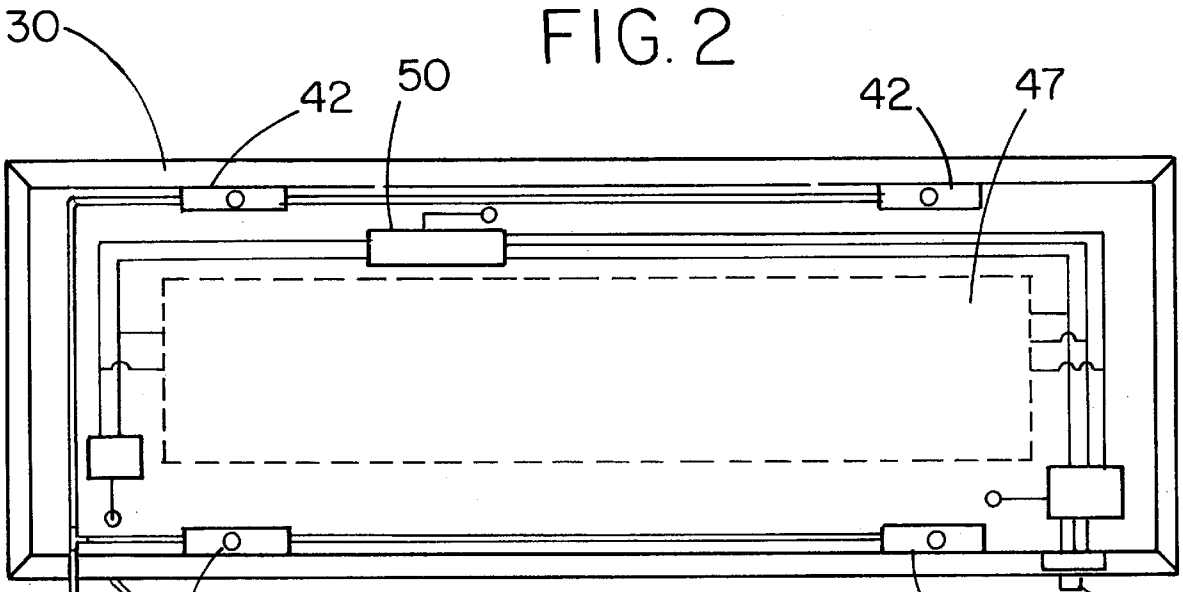
FIG. 2 is a schematic bottom view of the present invention with the legs of the chamber removed for clarity.
Figure 3:
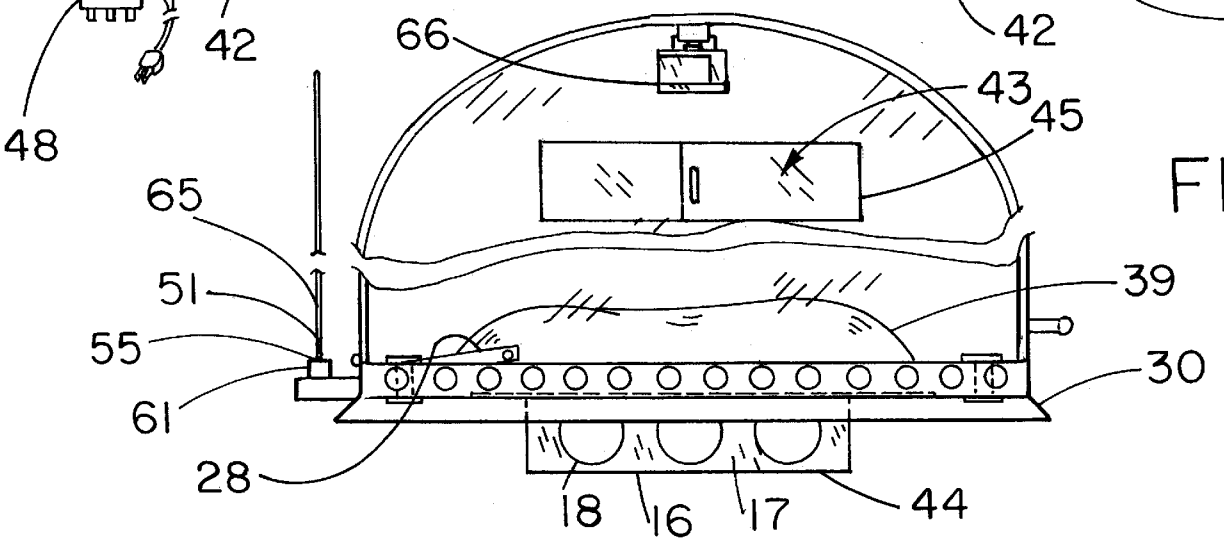
FIG. 3 is a schematic end view of the present invention.
Figure 4:
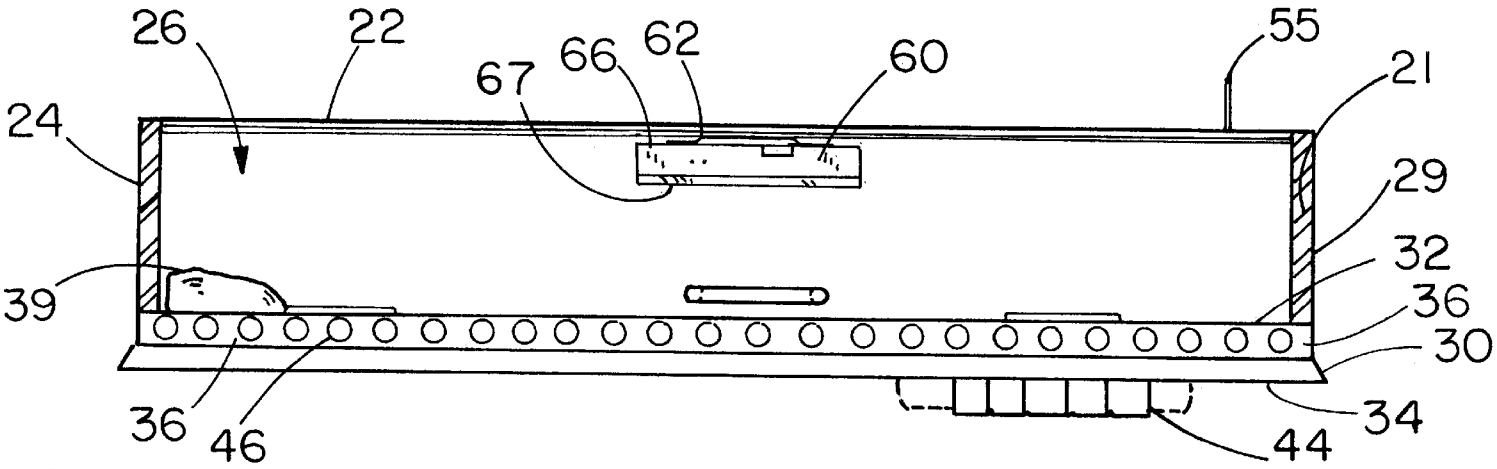
FIG. 4 is a schematic side view of the present invention.
Figure 6:
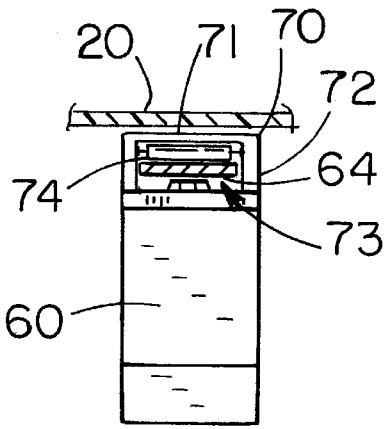
FIG. 6 is a schematic end view of the light assembly along line 6—6 of FIG. 5 of the present invention.
Figure 5:
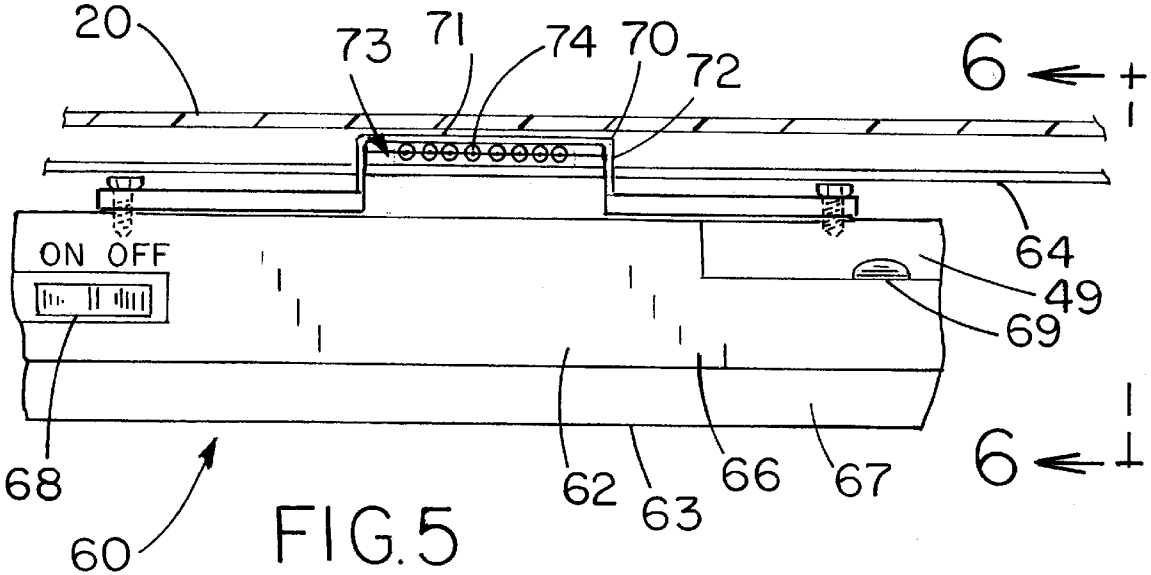
FIG. 5 is a schematic side view of the lighting assembly of the present invention.
Figure 7:
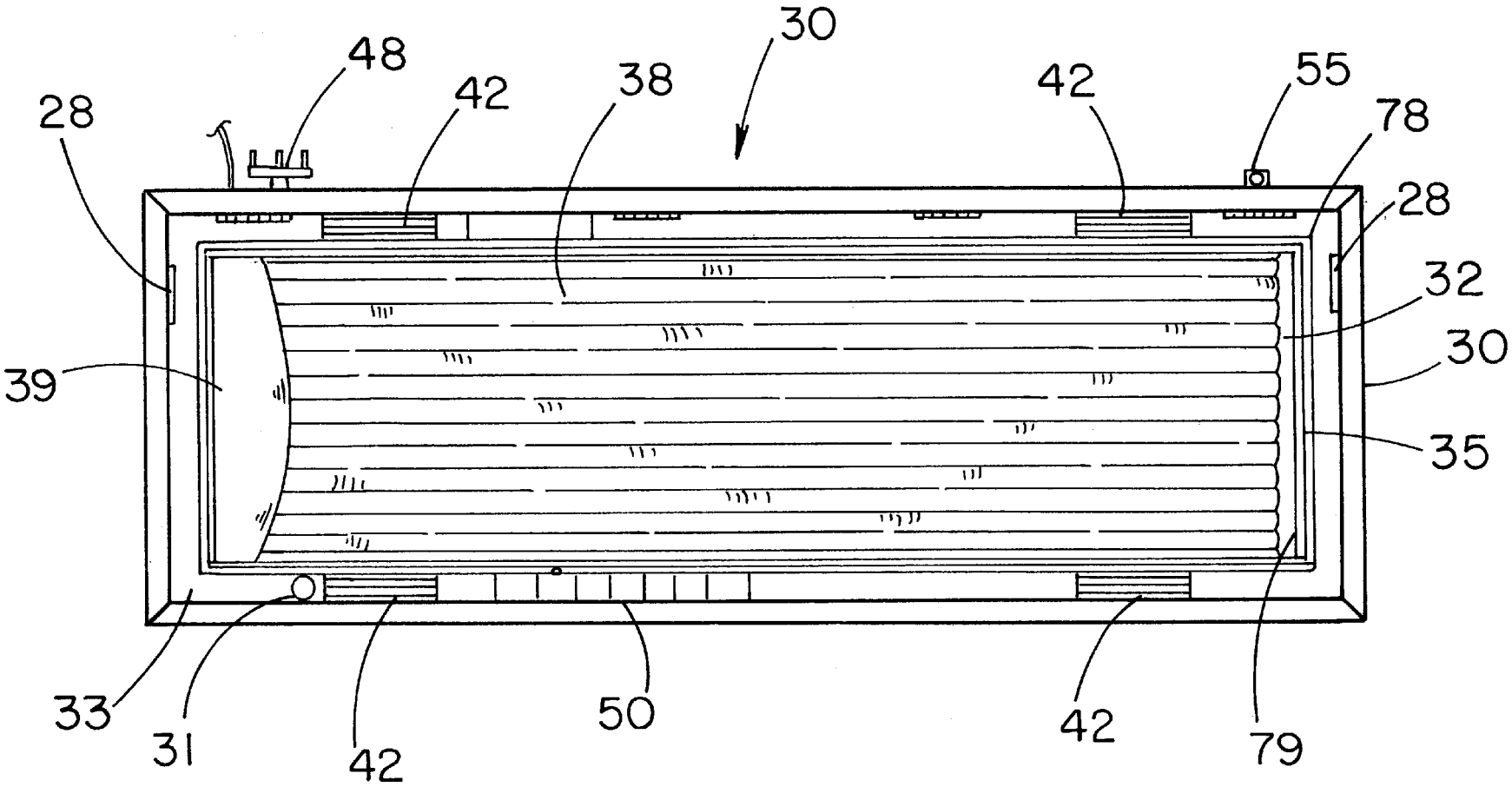
FIG. 7 is a schematic top view of the present invention.
Figure 8:
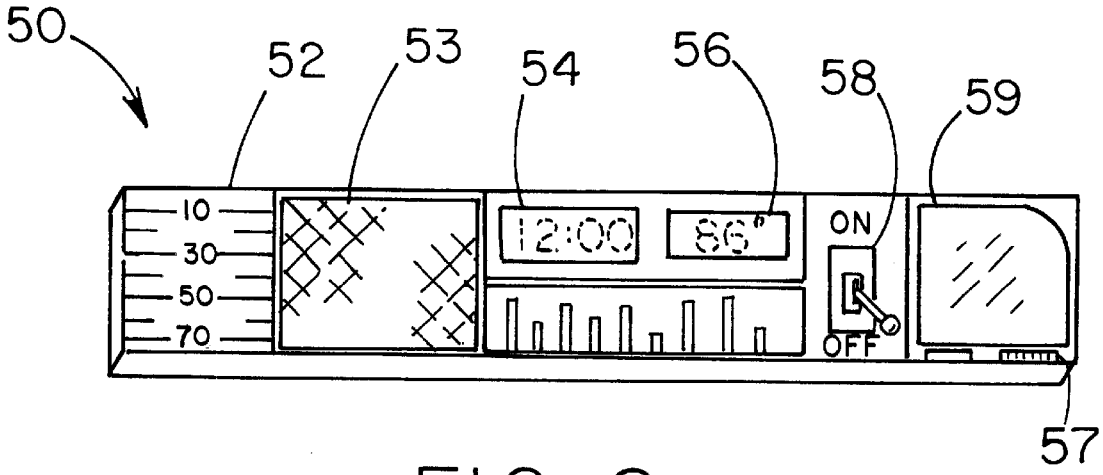
FIG. 8 is a schematic front view of the control panel of the present invention.
Figure 9:
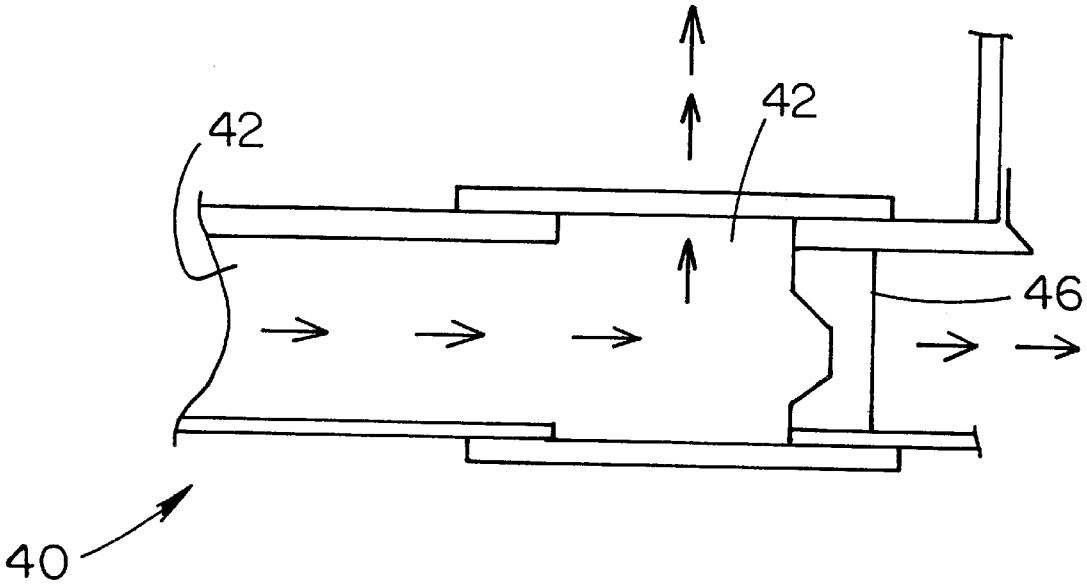
FIG. 9 is a schematic cross-section view of a portion of the gas flow path of the present invention.
Figure 10:
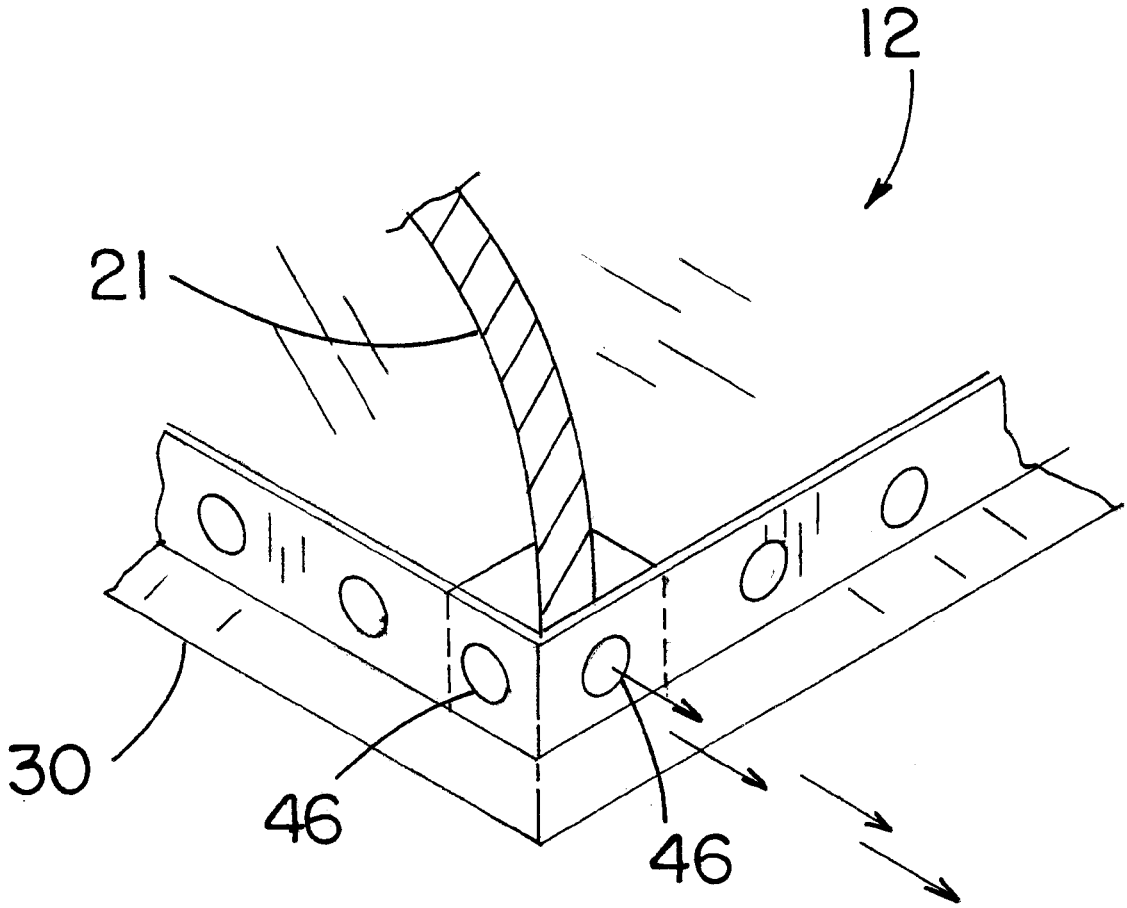
FIG. 10 is a schematic perspective view of a portion of the chamber of the present invention.
Figure 11:
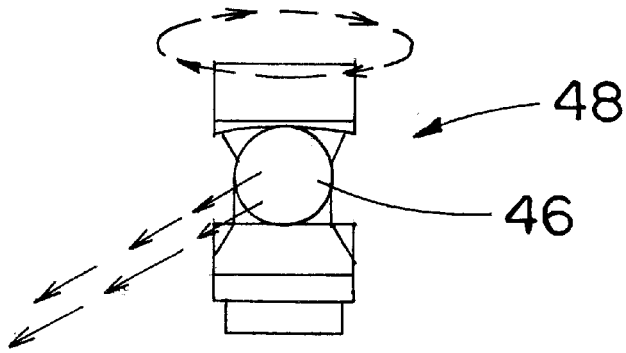
FIG. 11 is a schematic view of one of the valves of the present invention.
Figure 12:
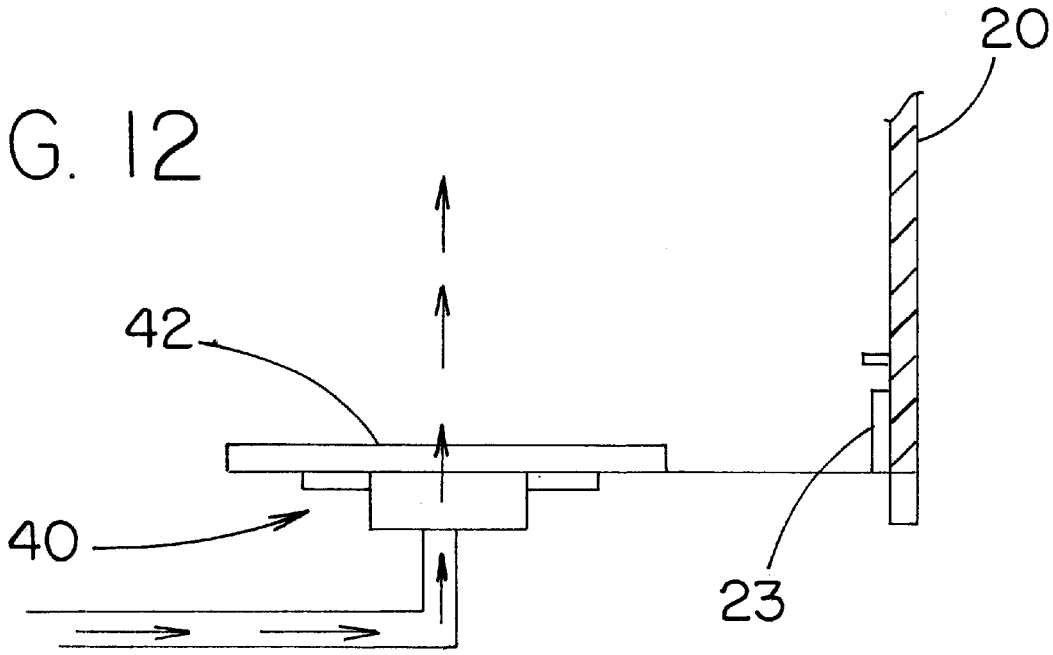
FIG. 12 is a schematic side view of a portion of the chamber particularly illustrating the airflow pattern of the present invention.

With reference now to the drawings, and in particular to FIGS. 1 through 12 thereof, a new hyperbaric oxygen chamber embodying the principles and concepts of the present invention and generally designated by the reference numeral 10 will be described.

As best illustrated in FIGS. 1 through 12, the hyperbaric oxygen chamber 10 generally comprises a chamber structure 12 that includes a base 30 and a cover 20, a vent system 40 in the base 30 of the chamber structure 12, a valve assembly 48 for use with the vent system 40, a control panel 50, a lighting assembly 60, and a support structure 75.

The cover 20 of the chamber structure 12 comprises an upper wall 22 and a pair of end walls 24 mounted on the upper wall 22. The upper wall 22, the end walls 24 and the base 30 together define a chamber 26 with an interior. The upper wall 22 may be pivotally mounted on the base 30, and preferably may have an arcuate shape with a semi-circular cross-section parallel to the end walls. Ideally, the cover is constructed from a three-quarter (¾) inch thick bulletproof plexiglass that is tinted. A lip 23 may be provided that extends around the edge of the cover 20.

A lockable hinge 28 may be provided that extends between the end wall 24 of the cover 20 and the base 30 for selectively locking the cover 20 in a raised position. The hinge may be located at least three inches from the end wall so that there is a greater clearance upon opening the cover. A strip of tape 29 may be placed on the upper wall 22 adjacent to each of the end walls 24 and includes a plurality of stripes 21 marked thereon. The strips may extend in a generally diagonal orientation to a longitudinal extent of the tape.

The base 30 has an upper surface 32 and a lower surface 34 and a perimeter wall surface 36 oriented generally perpendicular to the upper and lower surfaces 34. The base 30 may include a plurality of elongate generally tubular cushions 38 on the upper surface 32 for forming a sleeping surface, and may include a pillow 39 positioned on the sleeping surface. The base 30 may include a cup holder 31 formed therein, and ideally the cup holder 31 comprises a generally cylindrical depression formed in the upper surface 32 of the base 30. The base 30 may also include a book holder 33 formed therein, and ideally the book holder 33 comprises a generally rectangular depression formed in the upper surface 32 of the base 30. Auxiliary lights 35 may be provided which illuminate the interior of the chamber 26. The auxiliary lights 35 preferably comprise a plurality of light tubes 37. Each light tube is positioned along a portion of a periphery of the upper surface 32 of the base 30. Ideally, at least one of the light tubes 37 emits a red light 78, and at least one of the light tubes 37 emits a white light 79.

The vent system 40 in the base 30 permits gas to move into and out of the interior of the chamber 26. The vent system 40 includes a plurality of vent inlets 42 that are positioned on the upper surface 32 of the base 30 and that are in fluid communication with the interior of the chamber 26 for supplying gas or air to the interior of the chamber 26 and exhausting gas or air from the interior of the chamber 26. The vent inlets 42 are in communication with a gas supply 44. A plurality of vent outlets 46 is positioned on the perimeter wall surface 36 of the base 30 for passing gas exhausted from the interior of the chamber 26.

The valve assembly 48 selectively controls the flow of gas from the gas supply 44 into vent inlets 42.

The control panel 50 is mounted on the upper surface 32 of the base 30. The control panel 50 may include one or more of the following: a gas flow display 52 for displaying the quantity of the flow of gas into the interior of the chamber 26, a clock 54 designed with a display for indicating the time, a thermometer 56 that includes a display for indicating the temperature in the interior of the chamber 26, a light switch 58 that controls the flow of power to the auxiliary lights 35, and a television 59 that includes a screen as well as a speaker 53 and a volume control.

A lighting assembly 60 illuminates the interior of the chamber 26 and is mounted in the interior of the chamber 26. The lighting assembly 60 comprises a light carriage 62. A rail 64 supports the light carriage 62 in the chamber 26. The rail 64 is elongate and the light carriage 62 is movable between the ends of the rail 64. The ends of the rail 64 are positioned adjacent to ends of the chamber 26 and are mounted to the end walls 24 of the chamber structure 12. The light carriage 62 includes a housing portion 66 and a securing portion 70. The housing portion 66 comprises a housing and a light shading panel. A light (not shown) is situated in the housing and is positioned for shining light through the light shading panel. A switch 68 is mounted on the housing and includes an "off" position that precludes the supply of power to the light and an "on" position that permits the supply of power to the light. The housing includes a battery compartment 69 therein with a removable battery compartment 69 door selectively covering the battery compartment 69. The housing also includes a light access door to permit access to the light for removal and replacement of the light. A securing portion 70 includes a top wall 71 and a pair of spaced side walls 72 that extend upwardly from the housing portion 66 to the top wall 71. Thus, a channel 73 forms that receives the rail 64 therethrough. A plurality of roller bearings 74 are mounted adjacent to the top wall 71. The roller bearings 74 rest on a portion of the rail 64 passing through the channel 73.

The support structure 75 for supporting the chamber structure 12 may include four depending legs 76. Each leg 76 includes an upper end mounted on the base 30 of the chamber structure 12 and a lower end with a wheel mounted thereon. A plurality of cross braces 77 may be extended between the adjacent legs 76. The wheels may include casters 41.

One of the end walls 24 of the cover 20 may include an aperture 43 therein. A sliding door 45 may be mounted on the end wall 24 adjacent to the aperture 43 in a manner that permits the sliding door 45 to selectively close the aperture 43. The sliding door 45 may be designed so that the aperture 43 is not entirely closed at any time.

Additionally, a heating pad 47 may be provided that heats an upper surface 32 of the base 30. The heating pad 47 is mounted on the lower surface 34 of the base 30 of the chamber structure 12.

The chamber structure 12 may additionally comprise a handle mounted on the cover 20 for permitting hand lifting of the cover 20 with respect to the base 30.

A gas tank assembly may be mounted on a lower surface 34 of the base 30 of the chamber structure 12 and includes a tank holder adapted to hold at least one gas tank.

An antenna assembly 55 may optionally be included. The antenna assembly 55 mounts on the base 30 and comprises a mounting extension that extends outward from the perimeter wall surface 36 of the base 30. The antenna assembly 55 includes an antenna mast that includes a lower end mounted on the mounting extension and an upper end extending upwardly from the mounting extension. The antenna is in communication with the television 59 of the control panel 50.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus for providing an environment of raised pressure and enhanced oxygen content for a user, comprising:

a chamber structure having a base and a cover, the cover comprising an upper wall and a pair of end walls mounted on the upper wall, the upper wall, the end walls and the base defining a chamber with an interior; and the base comprising an upper surface and a lower surface and a perimeter wall surface oriented generally perpendicular to the upper and lower surfaces;

a vent system in the base for permitting gas to move into and out of the interior of the chamber, the vent system including:

a plurality of vent inlets positioned on the upper surface of the base and in fluid communication with the interior of the chamber for supplying air to the interior of the chamber and exhausting air from the interior of the chamber, the vent inlets being in communication with a gas supply; and a plurality of vent outlets positioned on the perimeter wall surface of the base for passing gas exhausted from the interior of the chamber;

auxiliary lights for illuminating the interior of the chamber, the auxiliary lights comprising a plurality of light tubes with each tube being positioned along a portion of a periphery of the upper surface of the base; and a valve assembly for selectively controlling the flow of gas from the gas supply into vent inlets.

2. The apparatus of claim 1 additionally comprising a control panel, the control panel being mounted on the upper surface of the base, the control panel having a gas flow display for displaying the quantity of the flow of gas into the interior of the chamber, a clock having a display for indicating the time, a thermometer having a display for indicating the temperature in the interior of the chamber, a light switch for controlling the flow of power to the auxiliary lights, a television having a screen and a speaker and a volume control.

3. The apparatus of claim 1 additionally comprising a lighting assembly for illuminating the interior of the chamber, the lighting assembly being mounted in the interior of the chamber.

4. The apparatus of claim 3 wherein the lighting assembly comprises a light carriage; and a rail for supporting the light carriage in the chamber, the rail being elongate and the light carriage being movable between ends of the rail, the ends of the rail being positioned adjacent to ends of the chamber, the ends of the rail being mounted to the end walls of the chamber structure.

5. The apparatus of claim 4 wherein the light carriage includes a housing portion and a securing portion, the housing portion including a housing and a light shading panel, a light situated in the housing and positioned for shining light through the light shading panel, a switch mounted on the housing and having an off position precluding a supply of power to the light and an on position permitting the supply of power to the light.

6. The apparatus of claim 5, wherein the housing includes a battery compartment therein with a removable battery compartment door selectively covering the battery compartment, the housing including a light access door for permitting access to the light for removal and replacement of the light, the securing portion including a top wall and a pair of spaced side walls extending upwardly from the housing portion to the top wall such that a channel is formed that receives the rail therethrough, a plurality of roller bearings being mounted adjacent to the top wall for resting on a portion of the rail passing through the channel.

7. The apparatus of claim 1 wherein the upper wall of the chamber is pivotally mounted on the base.

8. The apparatus of claim 7 additionally comprising a lockable hinge extending between the end wall of the cover and the base for selectively locking the cover in a raised position.

9. The apparatus of claim 1 wherein the upper wall has an arcuate shape with a semi-circular cross-section taken in a plane oriented substantially parallel to the end walls.

10. The apparatus of claim 1 additionally comprising a strip of tape placed on the upper wall adjacent to each of the end walls, the tape having a plurality of stripes marked thereon.

11. The apparatus of claim 1 wherein the base has a plurality of elongate generally tubular cushions on the upper surface for forming a sleeping surface, and a pillow positioned on the sleeping surface.

12. The apparatus of claim 1 wherein the base has a cup holder formed therein, the cup holder comprising a generally cylindrical depression formed in the upper surface of the base.

13. The apparatus of claim 1 wherein the base has a book holder formed therein, the book holder comprising a generally rectangular depression formed in the upper surface of the base.

14. The apparatus of claim 1 wherein at least one of the light tubes of the auxiliary lights emits a red light and at least one of the light tubes of the auxiliary lights emits a white light.

15. The apparatus of claim 1 additionally comprising a support structure for supporting the chamber structure, the support structure having a plurality of depending legs, each leg having an upper end mounted on the base of the chamber structure, each leg having a lower end with a wheel mounted thereon, and a plurality of cross braces extending between adjacent legs.

16. The apparatus of claim 1 additionally comprising a heating pad for heating an upper surface of the base, the heating pad being mounted on the lower surface of the base of the chamber structure.

17. An apparatus for providing an environment of raised pressure and enhanced oxygen content for a user, comprising:

a chamber structure having a base and a cover, the cover comprising an upper wall and a pair of end walls mounted on the upper wall, the upper wall, the end walls and the base defining a chamber with an interior; and the base comprising an upper surface and a lower surface and a perimeter wall surface oriented generally perpendicular to the upper and lower surfaces;

a vent system in the base for permitting gas to move into and out of the interior of the chamber, the vent system including:

a plurality of vent inlets positioned on the upper surface of the base and in fluid communication with the interior of the chamber for supplying air to the interior of the chamber and exhausting air from the interior of the chamber, the vent inlets being in communication with a gas supply; and a plurality of vent outlets positioned on the perimeter wall surface of the base for passing gas exhausted from the interior of the chamber;

a valve assembly for selectively controlling the flow of gas from the gas supply into vent inlets; and wherein one of the end walls of the cover has an aperture therein, and a sliding door is mounted on the end wall adjacent to the aperture in a manner permitting the sliding door to selectively close the aperture.

18. An apparatus for providing an environment of raised pressure and enhanced oxygen content for a user, comprising:

a chamber structure having a base and a cover, the cover comprising an upper wall and a pair of end walls mounted on the upper wall, the upper wall, the end walls and the base defining a chamber with an interior; and the base comprising an upper surface and a lower surface and a perimeter wall surface oriented generally perpendicular to the upper and lower surfaces;

a vent system in the base for permitting gas to move into and out of the interior of the chamber, the vent system including:

a plurality of vent inlets positioned on the upper surface of the base and in fluid communication with the interior of the chamber for supplying air to the interior of the chamber and exhausting air from the interior of the chamber, the vent inlets being in communication with a gas supply; and a plurality of vent outlets positioned on the perimeter wall surface of the base for passing gas exhausted from the interior of the chamber;

a valve assembly for selectively controlling the flow of gas from the gas supply into vent inlets; and an antenna assembly mounted on the base, the antenna assembly comprising a mounting extension extending outward from the perimeter wall surface of the base, and an antenna mast having a lower end mounted on the mounting extension and an upper end extending upwardly from the mounting extension.

* * * * *